United States Patent [19]

Testone

[11] 4,156,266

[45] May 22, 1979

[54] LIGHT FREE STATIC NEUTRALIZER

[75] Inventor: Anthony Q. Testone, Lee, Mass.

[73] Assignee: Static Inc., Lee, Mass.

[21] Appl. No.: 883,244

[22] Filed: Mar. 3, 1978

[51] Int. Cl.[2] ..... H01T 19/04

[52] U.S. Cl. ..... 361/213; 361/220; 361/229

[58] Field of Search ..... 361/212, 213, 214, 220, 361/229, 230; 250/324, 325, 326

[56] References Cited

U.S. PATENT DOCUMENTS

| | | | |
|---|---|---|---|
| 3,111,605 | 11/1963 | Muller et al. | 361/213 |
| 3,283,209 | 11/1966 | Schutz | 361/230 |
| 3,390,266 | 6/1968 | Epping | 250/326 |
| 3,409,768 | 11/1968 | Whitmore et al. | 361/229 X |
| 3,470,416 | 9/1969 | Radington-Meech et al. | 361/230 |
| 3,617,049 | 11/1971 | Testone | 271/105 |
| 3,675,096 | 7/1972 | Kiess | 250/325 X |
| 3,746,924 | 7/1973 | Testone | 361/230 |

*Primary Examiner*—Harry E. Moose, Jr.

*Attorney, Agent, or Firm*—Irvin A. Lavine

[57] ABSTRACT

A static neutralizer which emits ions without emitting light to the environment. The static neutralizer includes a body of insulating light absorbing material, having a cavity therein, with points of ion emitters located in the cavity. A passage leads from the cavity to the exterior, permitting flow of ions from the body and preventing passage of light from the ionizing points to the exterior. A metal sleeve surrounds the insulating material body with a peripheral edge of the metal band and the ionizing points preferably lying in a common plane. A source of electric potential, preferably alternating, is connected to the ion emitters, and the metal sleeve is connected to ground. Preferably, the connections are provided by a shielded cable having an inner conductor connected to the ion emitters, an outer, flexible woven wire shield connected to the metal band, and a light impervious, insulating layer on the exterior of the woven shield. The ion emitters are needles which penetrate the body and the inner conductor.

17 Claims, 5 Drawing Figures

LIGHT FREE STATIC NEUTRALIZER

BACKGROUND OF THE INVENTION

The present invention relates to a static neutralizer which emits ions in order to neutralize static electricity.

Static neutralizers have long been used for the purpose of suppressing or neutralizing static electricity. In known constructions, ion emitters are provided, having ionizing points, being made of conductive material and connected to a source of electric energy. The ion emitters may be supported in an appropriate structure, and often this has been some non-conductive material. A ground potential reference has been provided, as by a metal channel provided on the body of insulating material and connected to ground. Examples of such constructions include Muller et al U.S. Pat. No. 3,111,605 and Schutz U.S. Pat. No. 3,283,209. Also relevant in Radington-Meech et al U.S. Pat. No. 3,470,416. In some instances there has been provided in the prior art an insulated conductor, positioned in a supporting structure, with pins or needles passed through the insulation and through the conductive element, thereby forming the ion emitter and its connection to a linear conductor wire which may be connected to a source of electrical energy, such as high voltage alternating current. An example of this latter construction in Testone U.S. Pat. No. 3,746,924.

The prior art static neutralizers and ion emitters as above described have generally been provided for use in various mechanical processing machinery, and typically have been in the form of linearly extending bars.

Static neutralizers have also been utilized in various film feeding operations, including photographic film processing apparatus. In such apparatus, it is important that a suitable supply of ions be provided, without the emission of light from the static neutralizer, since in such apparatus, the emission of light would harm the photographic film. There are several products which have been on the market which are intended to generate ions, from static electricity and neutralization, without the emission of light. In one, a generally tubular ion generator has been provided with an angled extension elbow, intended to prevent the escape of light into the interior of the photographic film processing apparatus, and this static neutralizer is known to require a flow or air under pressure past the ionizing points, in order that a suitable supply of ions be introduced into the film processing apparatus. This has required, therefore, the provision of a source of air under pressure, and an additional conduit for the air extending into the film processing apparatus, to the ion generator. Another commercially produced apparatus has utilized a so-called static bar, which has linearly extending with a number of ionizing points, together with a pair of plates intended to shield the photographic film from any light emission at the exposed ionizing points. This construction was of low efficiency, requiring perhaps 3–4 minutes to obtain static neutralization, thereby requiring a long start-up time in order to avoid the risk of static charges which would damage the photographic film.

A further known ionizing air generating apparatus is disclosed in Testone U.S. Pat. No. 3,671,049, which discloses an ion generator in combination with the presser foot of a sheet feeding apparatus. The presser foot is disclosed as having a vertical passage, connected with a plurality of diverging horizontal passages, and a metal tube is inserted into the vertical passage. An ion generator is provided, including ionizing points extending through the presser foot, and into the metal tube. In this construction, since conventional paper was being fed in an open room, the emission of light from the ionizing points was not a matter of consideration. The ions generated at the ionizing points were caused to be blown through the metal tube and into the noted connecting passages in the presser foot, in order to distribute a flow of ionized air, although it is recognized that the proximity of the inner wall of the metal tube to the ionizing points caused a significant portion of the ions generated to be absorbed by the metal tube, with resulting decrease in ion output from the device. This made the device less efficient than desirable, and efficiency was further impaired by the restricted size of the outlet passages.

A static neutralizer is provided having a body of insulating material with a cavity, ionizing points of ion emitters being located in the cavity. The cavity is connected by an angled passage of substantially the same cross sectional area as the cavity to the exterior, the passage being at an angle so as to prevent the emission of light from the ionizing points out of the static neutralizer body. The surface of the body of insulating material is light absorbing, to prevent the reflection of light from the ionizing points, outwardly of the body. A metal sleeve surrounds the insulating body, having an upper edge which lies in a common plane, the ionizing points also lying in this plane. A coaxial cable is provided having an inner conductor, a surrounding insulating layer, and an outer conductor provided by woven metal threads. The outer conductor is connected to the metal sleeve, and the inner conductor and insulating layer extend through the metal sleeve and into the insulating body, the ionizing emitters in the form of pins or needles passing through the inner conductor and insulating layer and thereby being connected to the inner conductor. The inner conductor is connected to a source of electricity, and the outer conductor is grounded. A sheath of light impervious material, such as a tube of black plastic, encompasses the outer conductor, to prevent the escape of any light which might be caused by the field between the inner and outer conductors. The static neutralizer is of very small dimensions, being encompassed within an envelope of 1" by $1\frac{1}{2}$" by $1\frac{3}{4}$".

Among the objects of the present invention are to provide a static neutralizer of small size, capable of emitting a large amount of ions, and without emitting light. Another object is to provide a static neutralizer which, when used in connection with photographic film processing equipment, can provide a large amount of ionized air in a very short time, as within a fraction of a minute, and without requiring the use of compressed air. Still another object of the present invention is the provision of a static neutralizer in combination with a high voltage conductor which will prevent emission of light from both the neutralizer and the conductor.

Other objects and many of the attendant advantages of the present invention will be readily understood from the following drawings and description.

DESCRIPTION OF THE PREFERRED EMBODIMENT

Figure 1:
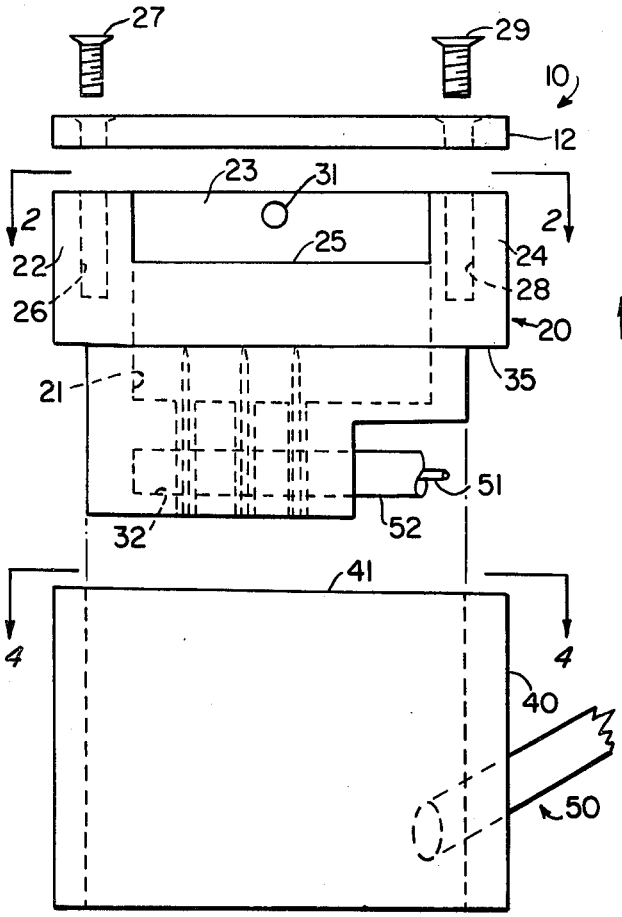
FIG. 1 is an exploded elevational view of a static neutralizer in accordance with the present invention, and with parts broken away.
Figure 2:
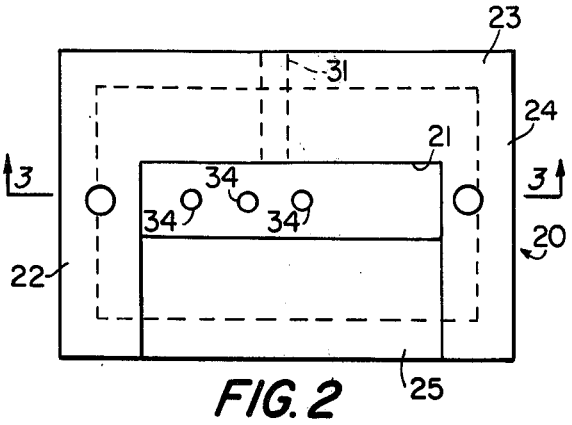
FIG. 2 is a view taken on the line 2—2 of FIG. 1.
Figure 3:
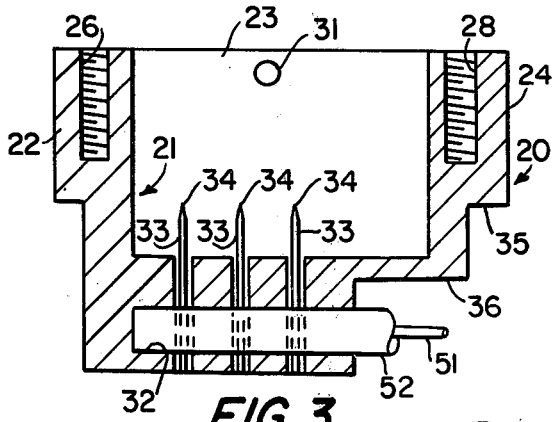
FIG. 3 is a cross-sectional view taken on the line 3—3 of FIG. 2.

Referring now to the drawings, wherein like or corresponding reference numerals are used for like or corresponding parts throughout the several views, there is shown in FIG. 1 a top plate 12, a housing 20, a metal sleeve 40, and a cable 50. The top plate 12 and housing 20 comprise a body, and are made of light absorbing insulating material. A suitable material is a plastic product of General Electric Company, Valox. As is shown in FIG. 3, the housing 20 has a cavity 21 therein. Upstanding walls 24 extend beyond the cavity 21, on three sides, leaving, as shown in FIG. 1, a forwardly facing opening. The opening extends from the cavity 21 forwardly (see FIG. 2) between the upstanding walls 22 and 24. The walls 22 and 24 have screw receiving holes 26 and 28, to receive the screws 27 and 29 for holding the top plate 12 in assembled relationship on the housing 20, screws 27 and 29 passing through suitable holes in the top plate 12. The top plate 12 is coextensive with the upper surface of the housing 20 as shown in FIG. 2, so that there is provided an angled passage extending to the exterior, formed by a portion of the bottom surface of the top plate 12, the inner surfaces of the upstanding walls 22, 23 and 24, and the upperwardly facing surface 25 of the housing 20 which extends between the walls 22 and 24. The cross-sectional area of the angled passage leading from the cavity to the exterior is of substantially the same cross-sectional area as the cavity itself, the cross-sectional area of the passage being that which is transverse to the plane of the top plate 12, and the cross-sectional area of the cavity being taken in a plane parallel to the top plate 12. There may be provided, optionally, an opening 31 through the wall 23, for the introduction of air, if desired, although for many installations, air blowing is not required.

As shown in FIGS. 1 and 3, a bore 32 is provided in the housing 20, below the cavity 21, and a conductor 51, with an insulating covering 52 is provided in bore 32. Pin-like ion emitters 33 are provided, having ionizing points 34 lying in a common plane, within the cavity 21, the ion emitters 33 passing through the bottom of housing 20 and through the conductor 51 and sleeve 52, to thereby establish electrical contact and connection between the ion emitters 33 and the conductor 51.

Housing 20 is provided with a downwardly facing shoulder 35, which is in substantially the same plane as the ionizing points 34.

Figure 4:
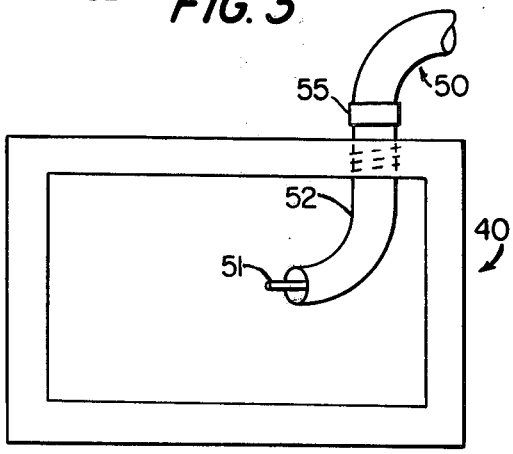
FIG. 4 is a view taken on the line 4—4 of FIG. 1.

The metal sleeve 40, shown in plan view in FIG. 4, telescopes over the lower part of the housing 20, sleeve 40 having an upper edge or surface 41 which abutts against the downwardly facing shoulder 35, and therefor this surface 41 lies in substantially the same plane as the points 34. The edge 41 will be seen to line a plane transverse to the axis of the sleeve 40. The location of the upper edge 41 coplanar with the ionizing points 34 is the preferred location, although the upper edge 41 may have other positions relative to ionizing points 34, within certain limits for acceptable efficiency. Those limits are defined by the relationship of a line extending from an ionizing point 34 to the closest point on the surface 41 of the sleeve 40, on the one hand, and a line passing through the closest of the ionizing points 34 which is either on the axis of the sleeve 40, or parallel to the axis of the sleeve 40. The angle between the ionizing point and the sleeve edge closest point should be at least 45 degrees relative to the line at or parallel to the sleeve axis, and passing through the closest ionizing point 34. Preferably, as is clear from FIG. 2, the ionizing points 34 lie on the axis of the cavity 21 and of the sleeve 40. The sleeve 40, as shown in FIG. 4, is a hollow right rectangular sleeve.

As shown in FIG. 4, the cable 50 is connected by a known connector 55 to the metal sleeve 40, connector 55 being threaded to the metal sleeve 40, and being swaged to a portion of the cable 50.

Figure 5:
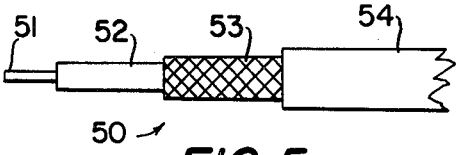
FIG. 5 is an elevational view, with parts broken away, of a coaxial cable in accordance with the invention.

Referring to FIG. 5, the cable 50 is shown, and comprises an inner conductor 51, a surrounding insulating layer 52, and an outer conductor 53 which is coaxial with the inner conductor 51, and which comprises woven or braided wire of known commercial construction. The inner conductor 51 is connected to a source of electric potential, such as 7,000 volts A.C. This is the potential which is supplied to the ion emitters 33. The metal sleeve of 40 is connected with ground through the connector 55 and the woven wire outer conductor 53. It has been found that due to the potential difference between the voltage on the wire 51 and the ground reference voltage on the outer conductor 53, a possibility exists that there will be an emission of light resulting from the field between the two conductors, and in order to prevent light from being emitted from the coaxial or concentric cable construction 51, 52 and 53, the conductor 53 is made light impervious. This is, preferably, by the placement over the conductor 53 of a light-impervious sheath 54, preferably made of flexible black plastic material. The sheath 54 will extend to, for example, the connector 55, and extend at least out of any processing equipment, so as to function to preclude the emission of light within the equipment itself.

As shown in FIG. 4, it is only the insulating layer 52 and inner conductor 51 which extend into the metal sleeve 40, and it will be noted that in FIG. 3, the housing 20 has a cut-a-way portion 36 which serves to accommodate the inner conductor 51 and insulating layer 52 in a space between the inner wall of the metal sleeve 40 and the bore 32.

As will be seen from FIG. 1, the axial length of the sleeve 40 is made greater than the length of the housing 20 between the shoulder 35 and the bottom surface thereof, below the bore 32. Into this space there may be introduced a plastic material in molten state, in order to seal off the inner conductor 51 and the insulating layer 52.

Mounting means may be provided, such as fastener elements threaded into the metal sleeve 40, although various mounting constructions may be utilized for the static neutralizer 10.

There has been provided a light-free static neutralizer of high efficiency, providing an unrestricted passage between a cavity in which ionizing points are located and the exterior, for the free outward flow of ions. The herein provided static neutralizer is light free not only at the neutralizer itself, but along the cable which supplies electric potential to the ionizing points. The static neutralizer is of extremely small construction, and is readily manufactured at low cost, while generating a sufficiently high quantity of ions to become effective within a fraction of a minute after it has commenced operation. In addition, although compressed air may be utilized in connection with the present static neutralizer, its output of ions is sufficiently high that in many normal installations, compressed air is not required.

It will be obvious to those skilled in the art that various changes may be made without departing from the spirit of the invention, and therefore the invention is not limited to that is shown in the drawings and described in the specification but only as indicated in the appended claims.

I claim:

1. A light free static neutralizer comprising:
a body having a cavity therein,
ion emitter means having ionizing point means, said ionizing point means being located in said cavity,
passage means in said body extending from said cavity to the exterior permitting the movement of ions from said ionizing point means to the exterior and preventing passage of light from said ionizing point means to the exterior of said body,
said body being of insulating material, the surfaces of said body directly exposed to said ionizing point means being substantially non-light reflecting,
a conductive element on the exterior of said body,
a first conductor for connecting said ion emitter means to a source of electric potential, and
a second conductor for connecting said conductive element to ground.

2. A light free static neutralizer as set forth in claim 1, wherein said passage means comprises a passage extending laterally from said cavity.

3. A light free static neutralizer as set forth in claim 2, said passage means providing a substantially unrestricted path for the flow of ions from said cavity to the exterior.

4. A light free static neutralizer as set forth in claim 1, said body comprising a housing, said cavity being within said housing, said housing having upstanding wall means extending beyond said cavity, an opening extending through said wall means, said body comprising plate means on said wall means, said plate means defining said passage means with said wall means and overlying said cavity.

5. A light free static neutralizer as set forth in claim 1, and further comprising means for introducing gaseous medium into said cavity for causing enhanced flow of ionized air from said cavity to the exterior.

6. A light free static neutralizer as set forth in claim 1, said conductive element being a sleeve in surrounding relationship to said body.

7. A light free static neutralizer as set forth in claim 1, said first and second conductors comprising a concentric shielded cable, said first conductor being surrounded by insulation and said second conductor surrounding said insultation.

8. A light free static neutralizer as set forth in claim 7, said second conductor being of woven wire.

9. A light free static neutralizer as set forth in claim 8, and further comprising means for preventing the escape of light from said shielded cable.

10. A light free static neutralizer as set forth in claim 9, wherein said last mentioned means comprises a light-impervious sheath on said second conductor.

11. A light free static neutralizer as set forth in claim 1, said conductive element comprising a sleeve having an edge lying in a plane generally transverse to the axis thereof, a line from the closest point on said sleeve edge to said ionizing point means extending to said ionizing point means being at an angle of at least 45 degrees to a line passing through said point means and parallel to said axis.

12. A light free static neutralizer as set forth in claim 11, wherein said ionizing point means is at approximately the axis of said sleeve.

13. A light free static neutralizer as set forth in claim 11, said body being of generally right rectangular shape, and said sleeve being a hollow right rectangular sleeve.

14. A light free static neutralizer as set forth in claim 13, said ionizing point means lying on the median plane of said body.

15. A light free static neutralizer as set forth in claim 1, said conductive element comprising a sleeve around said body and having an edge lying in a plane transverse to the axis of said sleeve, said ionizing point means located approximately in said plane.

16. A light free static neutralizer comprising:
a body having a cavity therein communicating with atmosphere,
ion emitter means having ionizing point means, said ionizing point means being located in said cavity,
passage means connected with said cavity for permitting the movement of ions from said body and preventing passage of light generated by said ionizing point means therefrom,
said body being of insulating material, the surfaces of said body directly exposed to said ionizing points being substantially non-light reflecting,
a conductive element on the exterior of said body,
a first conductor for connecting said ion emitter means to a source of electric potential,
a second conductor for connecting said conductive element to ground in surrounding relationship to said first conductor and insulated therefrom, and means for preventing the emission of light from said second conductor.

17. A light free static neutralizer as set forth in claim 16, said second conductor being of woven wire having a light-impervious sheath thereon.

* * * * *